US007406750B2

(12) United States Patent
Hösel

(10) Patent No.: US 7,406,750 B2
(45) Date of Patent: Aug. 5, 2008

(54) APPARATUS AT A SPINNING ROOM MACHINE FOR VISUAL SIGNAL DISPLAY

(75) Inventor: Fritz Hösel, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 676 days.

(21) Appl. No.: 10/961,153

(22) Filed: Oct. 12, 2004

(65) Prior Publication Data

US 2005/0083322 A1 Apr. 21, 2005

(30) Foreign Application Priority Data

Oct. 20, 2003 (DE) ..... 103 49 266

(51) Int. Cl.
*D01G 31/00* (2006.01)

(52) U.S. Cl. ..... 19/0.22

(58) Field of Classification Search ..... 19/0.22, 19/65 A; 340/815.45

See application file for complete search history.

(56) References Cited

U.S. PATENT DOCUMENTS

| | | | | |
|---|---|---|---|---|
| 4,522,236 | A | 6/1985 | Löhr | |
| 5,929,788 | A * | 7/1999 | Vukosic | 340/908.1 |
| 6,483,439 | B1 | 11/2002 | Vukosic | |
| 2002/0095235 | A1 | 7/2002 | Hosel | |

FOREIGN PATENT DOCUMENTS

| | | | |
|---|---|---|---|
| DE | 199 22 361 | C2 | 11/2000 |
| EP | 1 113 215 | A2 | 7/2001 |
| EP | 1 113 215 | A3 | 7/2001 |
| EP | 1 353 118 | A2 | 10/2003 |
| GB | 2 392 764 | A | 3/2004 |
| JP | 01 246425 | A | 10/1989 |
| JP | 10-11678 | A | 1/1998 |
| JP | 2000-195303 | A | 7/2000 |

OTHER PUBLICATIONS

Patent Abstracts of Japan, vol. 13, No. 589 (C-670) (Dec. 25, 1989).

* cited by examiner

*Primary Examiner*—Shaun R Hurley
(74) *Attorney, Agent, or Firm*—Venable LLP; Robert Kinberg; Steven J. Schwarz

(57) ABSTRACT

An apparatus at a spinning room machine, especially a spinning preparation machine, for example a carding machine or draw frame, for visual signal display, has at least two light sources in the form of light-emitting diodes (LEDs), each of which is associated with a cover, the signal display—which is in communication with a control device—being capable of emitting signals of light of different colours. In order to provide an apparatus which especially is of simple construction and allows a reduced outlay in terms of manufacture and installation, a plurality of LEDs, which are located inside a clear or opaque cover, are capable of emitting coloured or white light corresponding to the particular operating situation of the spinning room machine.

17 Claims, 4 Drawing Sheets

APPARATUS AT A SPINNING ROOM MACHINE FOR VISUAL SIGNAL DISPLAY

CROSS REFERENCE TO RELATED APPLICATION

This application claims priority from German Patent Application No. 103 49 266.6 filed Oct. 20, 2003, the entire disclosure of which is incorporated herein by reference.

BACKGROUND OF THE INVENTION

The invention relates to an apparatus at a spinning room machine, especially a spinning preparation machine, for example a carding machine or draw frame, for visual signal display, wherein at least two light sources in the form of light-emitting diodes (LEDs) are provided, which are associated with one cover, the signal display—which is in communication with a control device—being capable of emitting signals of light of different colours.

In practice, modern production machines or systems in a spinning room are capable of providing a user with a large amount of useful and in some cases absolutely necessary information. For a rapid overall view, signal pillars are often used, which consist of several signal generators of different colours arranged above one another. Depending on the particular application, up to five different signal generators can be present. A specific message is associated with each of the lamps or alternatively with combinations of more than one lamp. The messages may be, for example: red (continuous light), which indicates a machine malfunction; orange (flashing), which indicates can-changing. For each individual signal generator, a transparent coloured cover is used together with white filament bulbs or LEDs. It is disadvantageous therein that, for each colour or colour combination, there is required a filament bulb, a cover, a bulb fitting etc., as a result of which the signal generators are relatively complicated and, in addition, expensive.

It is an aim of the invention to provide an apparatus of the kind described at the beginning that avoids or mitigates the mentioned disadvantages and, especially, that is of simple construction and allows a reduced outlay in terms of manufacture and installation.

SUMMARY OF THE INVENTION

The invention provides a visual display device for a spinning room machine, comprising a plurality of light-emitting sources;

a cover inside which said light-emitting sources are located; and a control device for controlling said light emitting sources for generating coloured light in dependence on the operative state of the spinning room machine.

In the device according to the invention there is used only at least one transparent and colourless cover. Inside the cover there is used a combination of a plurality of coloured light-emitting diodes. The corresponding LEDs are triggered depending upon the signal that is to be delivered in a particular case. By that means, using only one lighting means (a plurality of LEDs in different colours) and only one cover, it is possible, depending on the particular LEDs in the arrangement, to deliver a large number of different coloured signals.

The light-emitting diodes may be capable of emitting different colours. Advantageously, single-colour light-emitting diodes are provided, at least two light-emitting diodes being capable of emitting colours that are different from one another. Multiple colour light-emitting diodes may be provided, the respective colours of which can be varied. The different colours of the multiple colour diodes may be adjustable (variable) by means of the control device. The signal display may be capable of emitting light signals each having one colour. The signal display may be capable of emitting light signals each having one colour combination. Advantageously, the light signals each having one colour or colour combination are arranged to be emitted successively. At least two light-emitting diodes may be capable of emitting light of different colours alternately.

The at least one cover may be transparent, and is advantageously glass-clear. The at least one cover may be opaque. The at least one cover may be colourless. Preferably, a single cover is provided. The light-emitting diodes are advantageously arranged inside the at least one cover. A combination of a plurality of coloured light-emitting diodes is used. The cover may be made from synthetic resin or the like. The cover may be in the form of a hollow cylinder, for example, of polygonal cross-section.

A light reflector may be provided in the beam path of the light-emitting diodes. The light reflector may be arranged between the light-emitting diodes and the inner wall of the light reflector. The light reflector may be of one part. Instead, the light reflector may be of more than one part. The light reflector may be approximately cone-shaped or truncated-cone-shaped. The light beams advantageously run from the light-emitting diodes, by way of the outer surface of the light reflector, through the wall surface of the cover. The nature of the colour emitted by the light-emitting diode or light-emitting diodes may be adjustable by means of the control device.

The invention also provides an apparatus at a spinning room machine, especially a spinning preparation machine, for example a carding machine or draw frame, for visual signal display—which is in communication with a control device—being capable of emitting signals of light of different colours, wherein a plurality of light-emitting diodes or lighting means, which are located inside a clear or opaque cover, are capable of emitting coloured or white light corresponding to the particular operating situation of the spinning room machine.

DETAILED DESCRIPTION OF PREFERRED EMBODIMENTS

Figure 1:
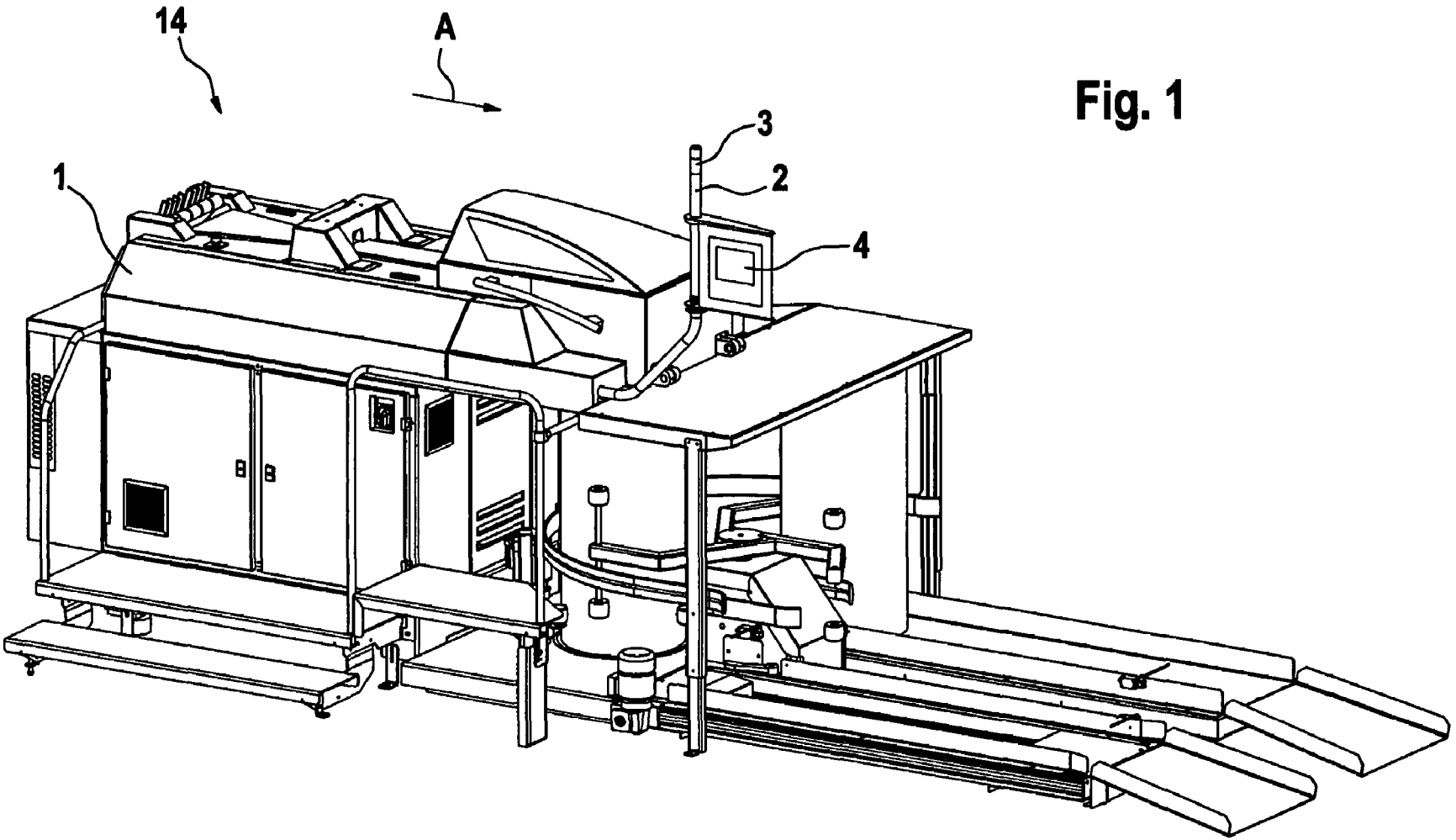
FIG. 1 is a diagrammatic perspective view of the machine panelling of a draw frame with an apparatus according to the invention.

FIG. 1 shows machine panelling 1 for a draw frame 14 (known per se), for example a draw frame made by Trutzschler GmbH & Co. KG of Mönchengladbach, Germany. The machine panelling 1 is a casing comprising walls, doors and flaps made from sheet metal, inside which the draw frame is located. In the region associated with the exit from the draw frame there is provided a holding device, for example a curved bar, tube 2 or the like, one end of which is fastened to the machine panelling 1 attached to the machine frame (not shown). Arranged in the region of the other end of the bar 2 is a visual signal generator 3 according to the invention. In addition, an operating and display device 4 is attached to the bar 2. Reference letter A denotes the work direction of the draw frame.

Figure 2:
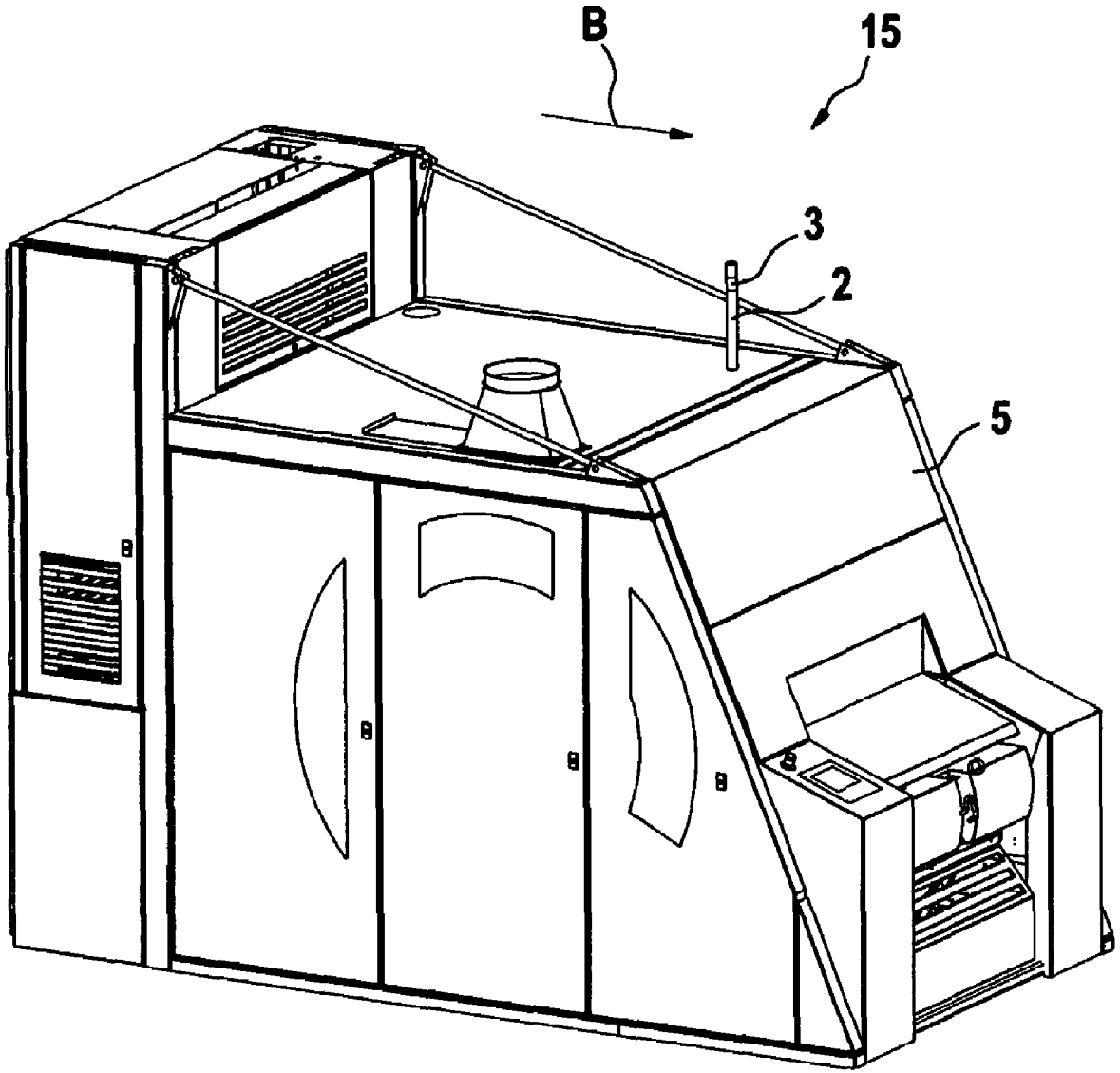
FIG. 2 is a diagrammatic perspective view of the machine panelling of a carding machine with an apparatus according to the invention.

FIG. 2 shows machine panelling 5 for a carding machine 15 (known per se), for example a Trützschler carding machine. The machine panelling 5 is a casing comprising walls, doors and flaps made from sheet metal, inside which the carding machine is located. In the region associated with the exit from the carding machine there is a holding device, for example a bar, tube 2 or the like, one end of which is fastened to the machine panelling, which is mounted on the machine frame (not shown). Arranged in the region of the other end of the bar 2 is a visual signal generator 3 according to the invention. Reference letter B denotes the work direction of the carding machine.

Figure 3A:
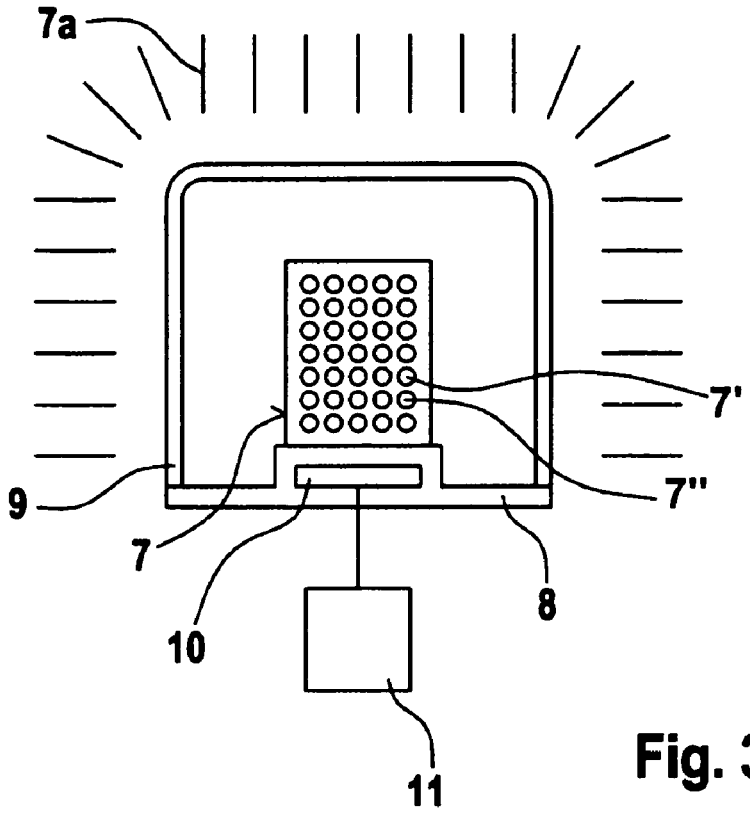
FIG. 3*a* is a cross-section through a signal generator according to the invention, emitting light of a first colour.
Figure 3B:
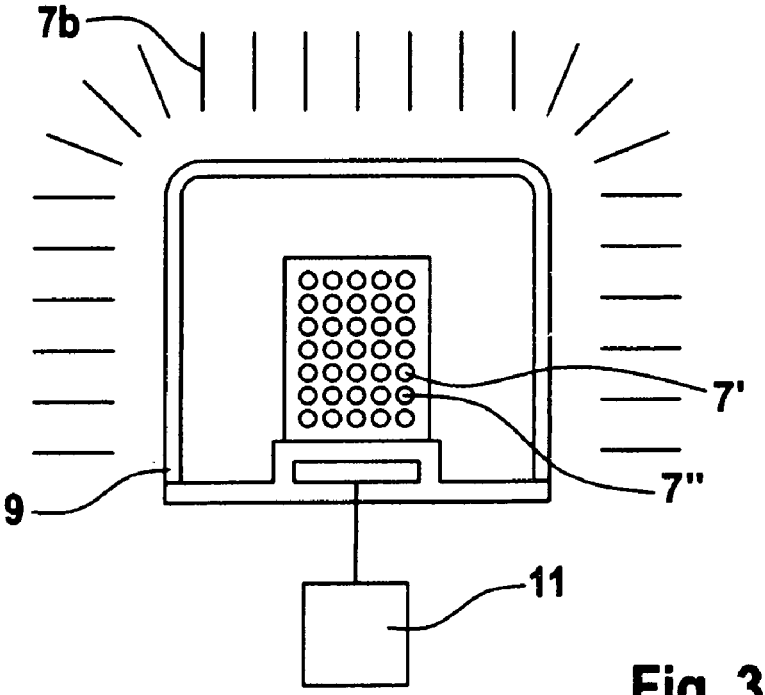
FIG. 3*b* is a cross-section through the signal generator of FIG. 3*a*, emitting light of a second colour.

In the embodiment of FIGS. 3*a*, 3*b*, a plurality of light-emitting diodes (LEDs) 7', 7" are connected to one another in succession, as a result of which a light source is formed. The plurality of light-emitting diodes 7', 7" are arranged vertically above one another in the form of a circle (around a vertical axis) and form a visual signal generator. The signal generator 7 is fastened onto a mounting pedestal 8 and is surrounded by a transparent, colourless cover 9, for example of plastics material. The mounting pedestal 8 is in the form of an electric circuit board. The light-emitting diodes 7', 7" are operated by means of an electrical circuitry arrangement 10, which is integrated into the mounting pedestal 8 and so forms a circuit board. The circuitry arrangement 10 is in communication with an electrical control device 11, for example the machine's control system. In accordance with the invention, light of the desired colour 7*a* and/or 7*b*, depending on the control instruction, is emitted.

In the embodiment of FIGS. 3*a*, 3*b*, a transparent and colourless cover is used, inside which a combination of a plurality of coloured light-emitting diodes come into operation (FIGS. 3*a* and 3*b*). Depending on the signal to be delivered in a particular case, the appropriate LEDs are triggered. For example:

| | | | |
|---|---|---|---|
| red | LEDs | correspond to | machine malfunction |
| green | LEDs | correspond to | everything in order |

etc.

Using only one lighting means (a plurality of LEDs in different colours) and only one cover, it is possible, depending on the particular LEDs in the arrangement, to deliver a large number of different coloured signals.

Likewise, colour combinations can also be produced as a result of off-setting over time.

Example for a combination of light-emitting diodes for red and green light:

In this case, the diodes emit red and green light alternately. In order for the individual colours still to be perceived as such by the viewer, a change-over of approximately one-second is advantageous, which means that the signal generator shines red for about one second, then green for one second and then again red for one second etc.

The signal generator can provide additional information by means of one or more colours emitting flashing light.

Use of the invention results in the following advantages, amongst others:

1. A single signal generator.
2. Only one cover with one light unit is required.
3. The outlay for the entire device is substantially reduced.
4. As a result of the use of light-emitting diodes, the service life of the light unit is almost infinitely long.

Figure 4:
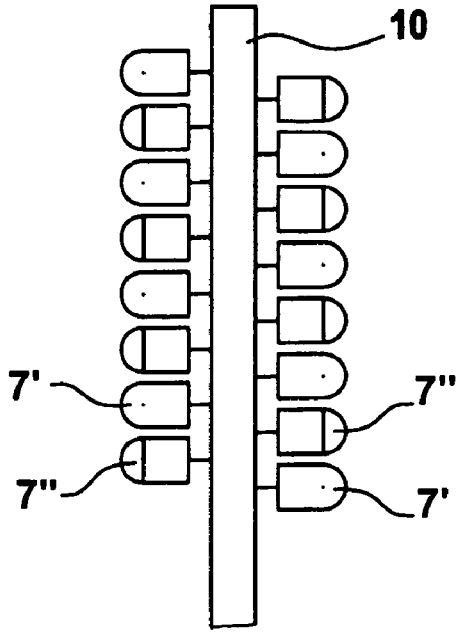
FIG. 4 is a side view of an embodiment having a two-sided arrangement of light-emitting diodes.
Figure 5:
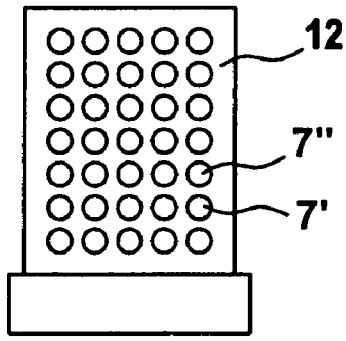
FIG. 5 is a side view of an embodiment having a reflective surface.

In the embodiment of FIG. 4, the light-emitting diodes 7', 7" are mounted on both sides of a circuit board 10. In the embodiment of FIG. 5, the circuit board 10 is so constructed that the intermediate spaces between the light-emitting diodes 7', 7" act as reflectors. For that purpose, the circuit boards are provided with a copper layer 12 over the entire surface on each side, in which layer the respective connections for the LEDs 7', 7" are integrated. If the rest of the copper layer is, for example, tin-coated, it acquires a silver-coloured, shiny and light-reflecting surface. Other reflective surface finishes, for example gilded finishes, are likewise possible.

Simply by supplying a relatively high current to the LEDs a flash effect can be obtained so that the use of an additional flash lamp is no longer necessary. Illumination and flash are accordingly possible using one and the same lamp. As a result, the functionality of the signal generator 7 is additionally increased without major outlay. The LEDs are generally supplied with pulsed current.

Figure 6:
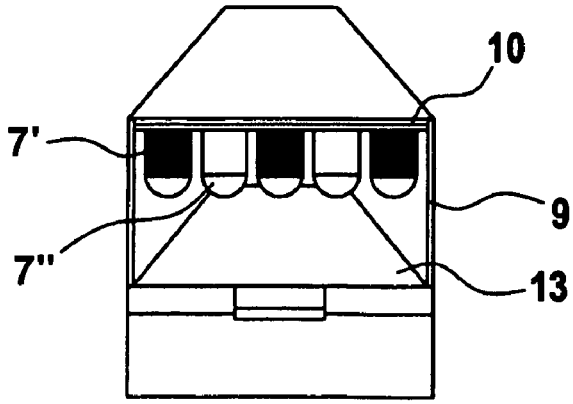
FIG. 6 is a side view of an embodiment having a conical reflecting mirror.

In the embodiment of FIG. 6, the light-emitting diodes 7', 7" are mounted on a circuit board 10. Opposite the circuit board 10 and the light-emitting diodes 7', 7" there is provided—inside the cover 9—a cone-shaped or truncated-cone-shaped mirror 13, the envelope surfaces of which are preferably at an angle of about 45°. Light is shone from the light-emitting diodes 7', 7" onto the mirror 13, is deflected through 90° by the mirror surface and is shone outwards through the cover 9.

When one kind of light-emitting diode emits white light, at least one other kind emits a different colour, that is to say white is considered in this case to be a colour.

Although the foregoing invention has been described in detail by way of illustration and example for purposes of understanding, it will be obvious that changes and modifications may be practiced within the scope of the appended claims.

What is claimed is:

1. A visual display device for a spinning room machine, comprising:

a cover including a substantially upright sidewall;

a circuit board oriented substantially horizontally with respect to the substantially upright sidewall;

a plurality of light-emitting sources mounted only on a single side of the circuit board;

a reflector located opposite the plurality of light-emitting sources, the reflector having a single uninterrupted reflecting surface that receives light from the plurality of light-emitting sources and deflects it through the substantially upright sidewall; and a control device for controlling the light-emitting sources for generating coloured light in dependence on the operative state of the spinning room machine.

2. A visual display device according to claim 1, in which the light-emitting sources are light-emitting diodes.

3. A visual display device according to claim 1, in which the light-emitting sources comprise single-colour light-emitting diodes, wherein at least two light-emitting diodes are capable of emitting colours that are different from one another.

4. A visual display device according to claim 1, in which the light-emitting sources comprise multiple colour light-emitting diodes, the respective colours of which can be varied.

5. A visual display device according to claim 4, in which the different colours of the multiple colour light-emitting diodes are variable by means of the control device.

6. A visual display device according to claim 1, in which the visual display is adapted to emit light signals each having one colour.

7. A visual display device according to claim 1, in which the visual display is adapted to emit light signals each having one colour combination.

8. A visual display device according to claim 1, in which light signals each having one colour or one colour combination are arranged to be emitted successively.

9. A visual display device according to claim 1, in which the plurality of light-emitting sources comprises at least two light-emitting diodes capable of emitting light of different colours alternately.

10. A visual display device according to claim 1, in which the cover is transparent.

11. A visual display device according to claim 1, in which the plurality of light-emitting diodes comprises a combination of coloured light-emitting diodes.

12. A visual display device according to claim 1, in which the cover is in the form of a hollow cylinder.

13. A visual display device according to claim 1, in which the reflector is arranged between the plurality of light-emitting sources and an inner wall of the cover.

14. A visual display device according to claim 1, in which the reflector is approximately cone-shaped or truncated-cone-shaped.

15. A visual display device according to claim 2, in which the colour emitted by the light-emitting diodes is adjustable by the control device.

16. A visual display device according to claim 1, comprising at least two groups of light-emitting sources, each group comprising two or more light-emitting diodes.

17. An apparatus at a spinning preparation machine for visually displaying an operating condition of the spinning preparation machine, comprising:

a cover including a substantially upright sidewall;

a circuit board oriented substantially horizontally with respect to the substantially upright sidewall;

a plurality of light-emitting diodes mounted only on a single side of the circuit board;

a reflector located opposite the plurality of light-emitting diodes, the reflector having a single uninterrupted reflecting surface that receives light from the plurality of light-emitting diodes and deflects it through the substantially upright sidewall; and a control device for controlling the light-emitting diodes to emit coloured or white light corresponding to the particular operating condition of the spinning preparation machine.

* * * * *